US010378283B2

(12) United States Patent
Peters

(10) Patent No.: US 10,378,283 B2
(45) Date of Patent: Aug. 13, 2019

(54) ROTARY STEERABLE SYSTEM WITH A STEERING DEVICE AROUND A DRIVE COUPLED TO A DISINTEGRATING DEVICE FOR FORMING DEVIATED WELLBORES

(71) Applicant: Volker Peters, Wienhausen (DE)

(72) Inventor: Volker Peters, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/210,707

(22) Filed: Jul. 14, 2016

(65) Prior Publication Data

US 2018/0016845 A1 Jan. 18, 2018

(51) Int. Cl.

| | |
|---|---|
| ***E21B 17/04*** | (2006.01) |
| ***E21B 17/10*** | (2006.01) |
| ***E21B 21/10*** | (2006.01) |
| ***E21B 4/02*** | (2006.01) |
| ***E21B 44/00*** | (2006.01) |
| ***E21B 47/06*** | (2012.01) |
| ***E21B 47/12*** | (2012.01) |
| ***E21B 7/06*** | (2006.01) |
| ***E21B 7/24*** | (2006.01) |
| ***E21B 47/18*** | (2012.01) |

(Continued)

(52) U.S. Cl.

CPC ..... *E21B 7/067* (2013.01); *E21B 4/02* (2013.01); *E21B 7/068* (2013.01); *E21B 7/24* (2013.01); *E21B 17/04* (2013.01); *E21B 17/05* (2013.01); *E21B 17/1078* (2013.01); *E21B 17/20* (2013.01); *E21B 21/10* (2013.01); *E21B 44/00* (2013.01); *E21B 47/06* (2013.01); *E21B 47/065* (2013.01); *E21B 47/12* (2013.01); *E21B 47/122* (2013.01); *E21B 47/18* (2013.01)

(58) Field of Classification Search

CPC . E21B 7/067; E21B 4/02; E21B 7/068; E21B 7/24; E21B 17/04; E21B 17/05; E21B 17/1078; E21B 17/20

See application file for complete search history.

(56) References Cited

U.S. PATENT DOCUMENTS

| | | | |
|---|---|---|---|
| 2,971,770 | A | 2/1961 | Wagner |
| 3,743,034 | A | 7/1973 | Bradley |

(Continued)

FOREIGN PATENT DOCUMENTS

| | | | |
|---|---|---|---|
| WO | 2003052236 | A1 | 6/2003 |
| WO | 2003052237 | A1 | 6/2003 |

OTHER PUBLICATIONS

PCT International Search Report and Written Opinion; International Application No. PCT/US2017/041632; International Filing Date: Jul. 12, 2017; dated Sep. 22, 2017; pp. 1-13.

(Continued)

*Primary Examiner* — David J Bagnell
*Assistant Examiner* — Dany E Akakpo
(74) *Attorney, Agent, or Firm* — Cantor Colburn LLP

(57) ABSTRACT

A rotary drilling apparatus for drilling deviated wellbores Is disclosed that in one embodiment includes a drilling assembly that further includes a drilling motor coupled to a drive member to rotate a disintegrating device, a housing outside the drive member having a lower section and an upper section, and a steering device disposed outside the drive member that tilts the lower section relative to the upper section and maintains the tilt geostationary or substantially geostationary when the drilling assembly is rotating to drill a deviated section of the wellbore.

24 Claims, 6 Drawing Sheets

(51) Int. Cl.
*E21B 17/05* (2006.01)
*E21B 17/20* (2006.01)

(56) References Cited

U.S. PATENT DOCUMENTS

| | | | |
|---|---|---|---|
| 3,941,197 | A | 3/1976 | Stinson |
| 4,703,814 | A | 11/1987 | Nguyen |
| 4,974,688 | A | 12/1990 | Helton |
| 5,671,816 | A | 9/1997 | Tibbitts |
| 6,092,610 | A | 7/2000 | Kosmala et al. |
| 6,109,372 | A | 8/2000 | Dorel et al. |
| 6,158,529 | A | 12/2000 | Dorel |
| 6,837,315 | B2 | 1/2005 | Pisoni et al. |
| 7,188,685 | B2 | 3/2007 | Downton et al. |
| 7,360,609 | B1 | 4/2008 | Falgout, Sr. |
| 7,762,356 | B2 | 7/2010 | Turner et al. |
| 7,802,637 | B2 | 9/2010 | Aronstam et al. |
| 8,469,117 | B2 | 6/2013 | Pafitis et al. |
| 8,590,636 | B2 | 11/2013 | Menger |
| 8,763,725 | B2 | 7/2014 | Downton |
| 9,057,223 | B2 | 6/2015 | Perrin et al. |
| 9,145,736 | B2 | 9/2015 | Peter et al. |
| 9,828,804 | B2 | 11/2017 | Pearce et al. |
| 2003/0127252 | A1 | 7/2003 | Downton et al. |
| 2009/0008151 | A1 | 1/2009 | Turner et al. |
| 2009/0032302 | A1 | 2/2009 | Downton et al. |
| 2009/0272579 | A1 | 11/2009 | Sihier et al. |
| 2010/0108380 | A1 | 5/2010 | Teodorescu et al. |
| 2011/0100716 | A1 | 5/2011 | Shepherd |
| 2011/0284292 | A1 | 11/2011 | Gibb et al. |
| 2012/0018225 | A1 | 1/2012 | Peter et al. |
| 2013/0341098 | A1 | 12/2013 | Perrin et al. |
| 2014/0110178 | A1 | 4/2014 | Savage et al. |
| 2014/0209389 | A1 | 7/2014 | Sugiura et al. |
| 2015/0114719 | A1 | 4/2015 | Pearce et al. |
| 2016/0108679 | A1 | 4/2016 | Bayliss |
| 2017/0044834 | A1 | 2/2017 | Peters |
| 2018/0016844 | A1 | 1/2018 | Peters |
| 2018/0016846 | A1 | 1/2018 | Peter et al. |

OTHER PUBLICATIONS

PCT International Search Report and Written Opinion; International Application No. PCT/US2017/041634; International Filing Date: Jul. 12, 2017; dated Sep. 22, 2017; pp. 1-13.

PCT International Search Report and Written Opinion; International Application No. PCT/US2017/041635; International Filing Date: Jul. 12, 2017; dated Sep. 22, 2017; pp. 1-13.

ROTARY STEERABLE SYSTEM WITH A STEERING DEVICE AROUND A DRIVE COUPLED TO A DISINTEGRATING DEVICE FOR FORMING DEVIATED WELLBORES

CROSS REFERENCES TO RELATED APPLICATIONS

The present application is related to U.S. patent application Ser. No. 15/210,669 and U.S. patent application Ser. No. 15/210,735, filed Jul. 14, 2016, the contents of which are hereby incorporated by reference herein in their entirety.

BACKGROUND

1. Field of the Disclosure

The disclosure relates generally to drilling of wellbores and particularly to a drilling assembly that combines a drilling motor, such as a mud motor, into a rotary steerable apparatus for drilling deviated wellbores.

2. Background Art

Wells or wellbores are formed for the production of hydrocarbons (oil and gas) trapped in subsurface formation zones. To drill a deviated wellbore, a drilling assembly (also referred to as a bottom hole assembly or "BHA") that includes a steering device to tilt a drill bit is used. The steering device typically tilts a lower portion of the drilling assembly by a selected amount and along a selected direction to form the deviated portions of the wellbores. Various types of steering devices have been proposed and used for drilling deviated wellbores. The drilling assembly also includes a variety of sensors and tools that provide a variety of information relating to the earth formation and drilling parameters.

One such steering system, referred to as rotary steerable system, contains a steering mechanism positioned adjacent to the drill bit. Such steerable systems either push the bit or point the bit type or a combination thereof, featuring various steering and actuation mechanisms. Such steerable systems either are connected to the drill pipe all the way up to the surface and rotate with the drill pipe rpm or are placed below a mud motor and rotate with superimposed drill pipe rpm and drilling motor rpm. Such rotary systems are fairly complex and relatively long. Although, a drilling motor may be used to steer a wellbore without rotation of the drilling assembly by sliding the drilling assembly having a fixed bend into the desired direction, but a rotary drilling system has various advantages over the sliding systems, including reduction in the friction experienced by the rotating drilling assembly, improved cuttings transportation to the surface, etc.

The disclosure herein provides a rotary steering system and methods for forming deviated wellbores that combines or integrates a steering system with a mud motor for drilling straight and deviated wellbores, wherein the drilling motor may be continuously rotated for forming curved and the straight sections of the wellbore by rotating the drill sting at a relatively low rotational speed compared to conventional methods.

SUMMARY

In one aspect, a rotary steerable drilling assembly for drilling a deviated wellbore is disclosed that in one embodiment includes: a drilling motor coupled to a drive member configured to rotate a drill bit; a housing outside the drive member; and a steering device disposed outside the drive member, wherein the steering device tilts a lower section of the housing relative to an upper section about a joint associated with the steering device and maintains the tilt geostationary while the drilling assembly is rotating.

In another aspect, a method of forming a deviated wellbore is disclosed that in one embodiment includes: conveying a drilling assembly into the wellbore that includes a drilling motor coupled to a drive member configured to rotate a drill bit, a housing outside the drive member and a steering device disposed outside the drive member that tilts a first section of the housing relative to a second section to tilt the drill bit; rotating the drilling assembly and the drilling motor to rotate the drill bit to drill the wellbore; and activating the steering device to tilt the first section relative to the second section to form the deviated wellbore and to maintain the tilt of the first section geostationary.

Examples of certain features of an apparatus and methods have been summarized rather broadly in order that the detailed description thereof that follows may be better understood, and in order that the contributions to the art may be appreciated. There are, of course, additional features that will be described hereinafter and which will form the subject of the claims.

DRAWINGS

For a detailed understanding of the apparatus and methods disclosed herein, reference should be made to the accompanying drawings and the detailed description thereof, wherein like elements are generally given same numerals and wherein.

DETAILED DESCRIPTION

Figure 1:
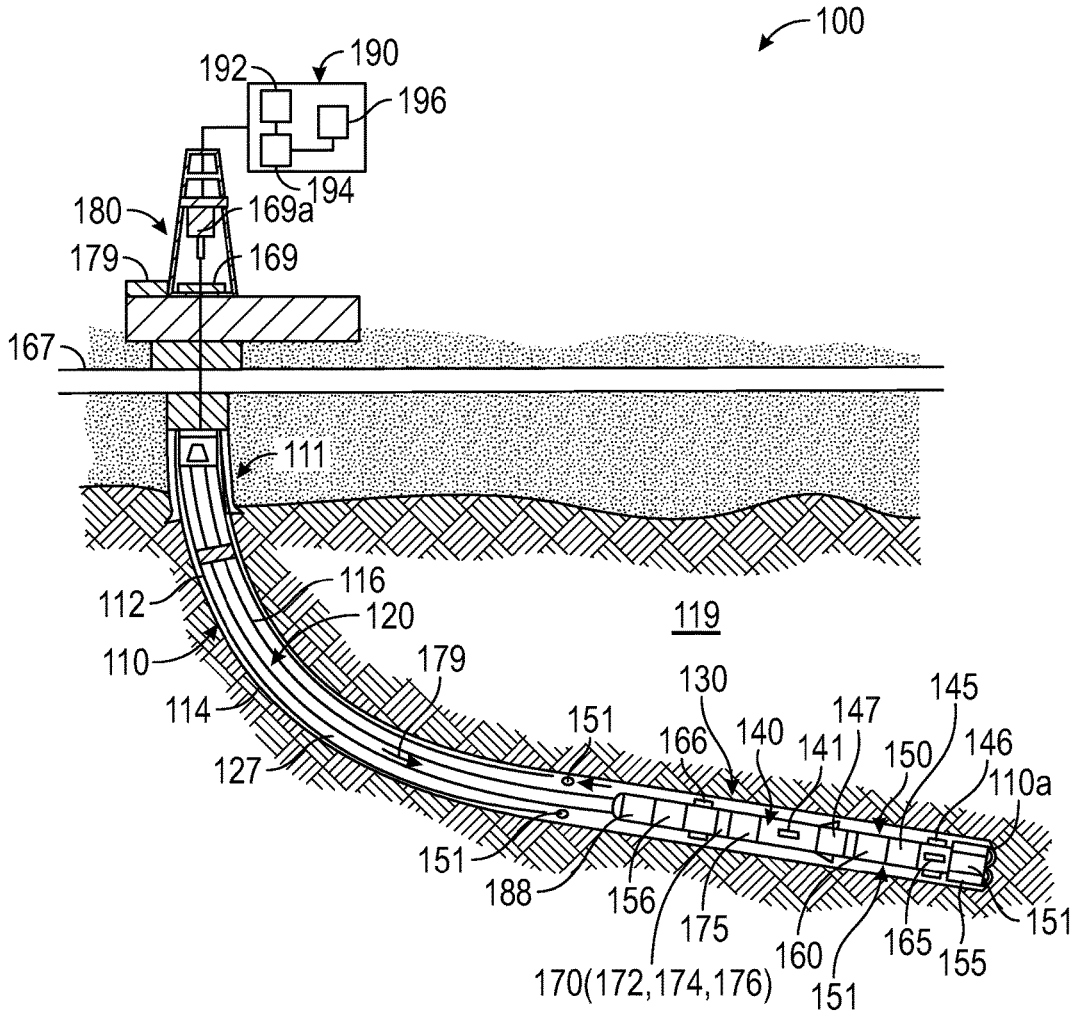
FIG. 1 shows a schematic diagram of an exemplary drilling system that utilizes a drilling assembly that utilizes a steering device made according to an embodiment of the disclosure here.

FIG. 1 is a schematic diagram of an exemplary drilling system 100 that may utilize a steering device or unit in a drilling assembly of a rotary drilling system for drilling straight and deviated wellbores. A deviated wellbore is any wellbore that is non-vertical. The drilling system 100 is shown to include a wellbore 110 (also referred to as a "borehole" or "well") being formed in a formation 119 that includes an upper wellbore section 111 with a casing 112 installed therein and a lower wellbore section 114 being drilled with a drill string 120. The drill string 120 includes a tubular member 116 (also referred to herein as "drill pipe") that carries a drilling assembly 130 (also referred to as the "bottom hole assembly" or "BHA") at its bottom end. The drilling tubular 116 may be a drill pipe made up by joining pipe sections. The drilling assembly 130 has a disintegrating device, such as a drill bit 155, attached to its bottom. The drilling assembly 130 also may include a number of devices, tools and sensors, as described below. The drilling assembly 130 includes a drilling motor (commonly referred to as the "mud motor") 140. A rotor in the drilling motor 140 is connected to a drive member that includes a flexible transmission member or shaft 141 connected to a drill bit drive shaft 165. The drill bit drive shaft 165 is connected to the drill bit 155. The drilling motor 140 rotates due to the flow of the drilling fluid 179 through the drilling motor 140. The rotor in the drilling motor 140 rotates the flexible transmission shaft 141 that in turn rotates the drill bit drive shaft 165 and thus the drill bit 155. The flexible transmission shaft 141 and the drill bit drive shaft 142 are disposed inside a housing 160. The drilling assembly 130 includes a steering device 150 (also referred to as the steering unit, steering section or steering assembly) disposed around the drive member that tilts a lower section 146 of the drilling assembly relative to an upper section 145 of the drilling assembly 130 about a joint 147 of the steering device 150 as described in more detail In reference to FIGS. 2A-4.

Still referring to FIG. 1, the drill string 120 is shown conveyed into the wellbore 110 from an exemplary rig 180 at the surface 167. The exemplary rig 180 in FIG. 1 is shown as a land rig for ease of explanation. The apparatus and methods disclosed herein may also be utilized with offshore rigs. A rotary table 169 or a top drive 169*a* coupled to the drill string 118 may be utilized to rotate the drill string 120 and thus the drilling assembly 130 and the drill bit 155. In the system 100, the drill bit 155 also is rotated by the drilling motor 140. Thus the drill bit rotation is the sum of the drill string rpm and the drilling motor rpm. A control unit (also referred to as a "controller" or "surface controller") 190 at the surface 167, which may be a computer-based system, may be utilized for receiving and processing data transmitted by various sensors and tools (described later) in the drilling assembly 130 and for controlling selected operations of the various devices and sensors in the drilling assembly 130, including the steering unit 150. The surface controller 190 may include a processor 192, a data storage device (or a computer-readable medium) 194 for storing data and computer programs 196 accessible to the processor 192 for determining various parameters of interest during drilling of the wellbore 110 and for controlling selected operations of the various tools in the drilling assembly 130 and those of drilling of the wellbore 110. The data storage device 194 may be any suitable device, including, but not limited to, a read-only memory (ROM), a random-access memory (RAM), a flash memory, a magnetic tape, a hard disc and an optical disk. To drill the wellbore 110, a drilling fluid 179 is pumped under pressure into the tubular member 116, which fluid passes through the drilling assembly 130 and the drilling motor 140 and discharges at the bottom 110*a* of the drill bit 155. The drilling fluid flow causes a rotor in the drilling motor to rotate. The drill bit 155 disintegrates the formation rock into cuttings 151. The drilling fluid 179 returns to the surface 167 along with the cuttings 151 via the annular space (also referred as the "annulus") 127 between the drill string 120 and the wellbore 110.

Still referring to FIG. 1, the drilling assembly 130 may further include one or more downhole sensors (also referred to as the measurement-while-drilling (MWD) sensors, logging-while-drilling (LWD) sensors or tools, and other devices, collectively referred to as downhole devices or sensors and are designated by numeral 175, and at least one control unit or controller 170 for processing data received from downhole devices 175. The downhole devices 175 may include sensors for providing measurements relating to various drilling parameters, including, but not limited to, BHA orientation, tool face, vibration, whirl, stick-slip, flow rate, pressure, temperature, and weight-on-bit. The drilling assembly 130 further may include tools, including, but not limited to, a resistivity tool, an acoustic tool, a gamma ray tool, a nuclear tool and a nuclear magnetic resonance tool that provide data relating to properties of the formation around the drilling assembly 130. Such devices are known in the art and are thus not described herein in detail. The drilling assembly 130 also includes a power generation device 186 and a suitable telemetry unit 188, which may utilize any suitable telemetry technique, including, but not limited to, mud pulse telemetry, electromagnetic telemetry, acoustic telemetry and wired pipe. Such telemetry techniques are known in the art and are thus not described herein in detail. The steering unit 150 enables an operator to steer the drill bit 155 in desired directions to drill deviated wellbores. Stabilizers, such as stabilizers 162 and 164 are provided along the steering section 150 to stabilize the steering section. Additional stabilizers, such as stabilizer 166, may be used to stabilize the drilling assembly 130. The controller 170 may include a processor 172, such as a microprocessor, a data storage device 174 and a program 176 accessible to the processor 172. The controller 170 communicates with the controller 190 to control various functions and operations of the tools and devices in the drilling assembly. During drilling, the steering device 150 controls the tilt and direction of the drill bit 155, as described in more detail in reference to FIGS. 2-4.

Figure 2A:
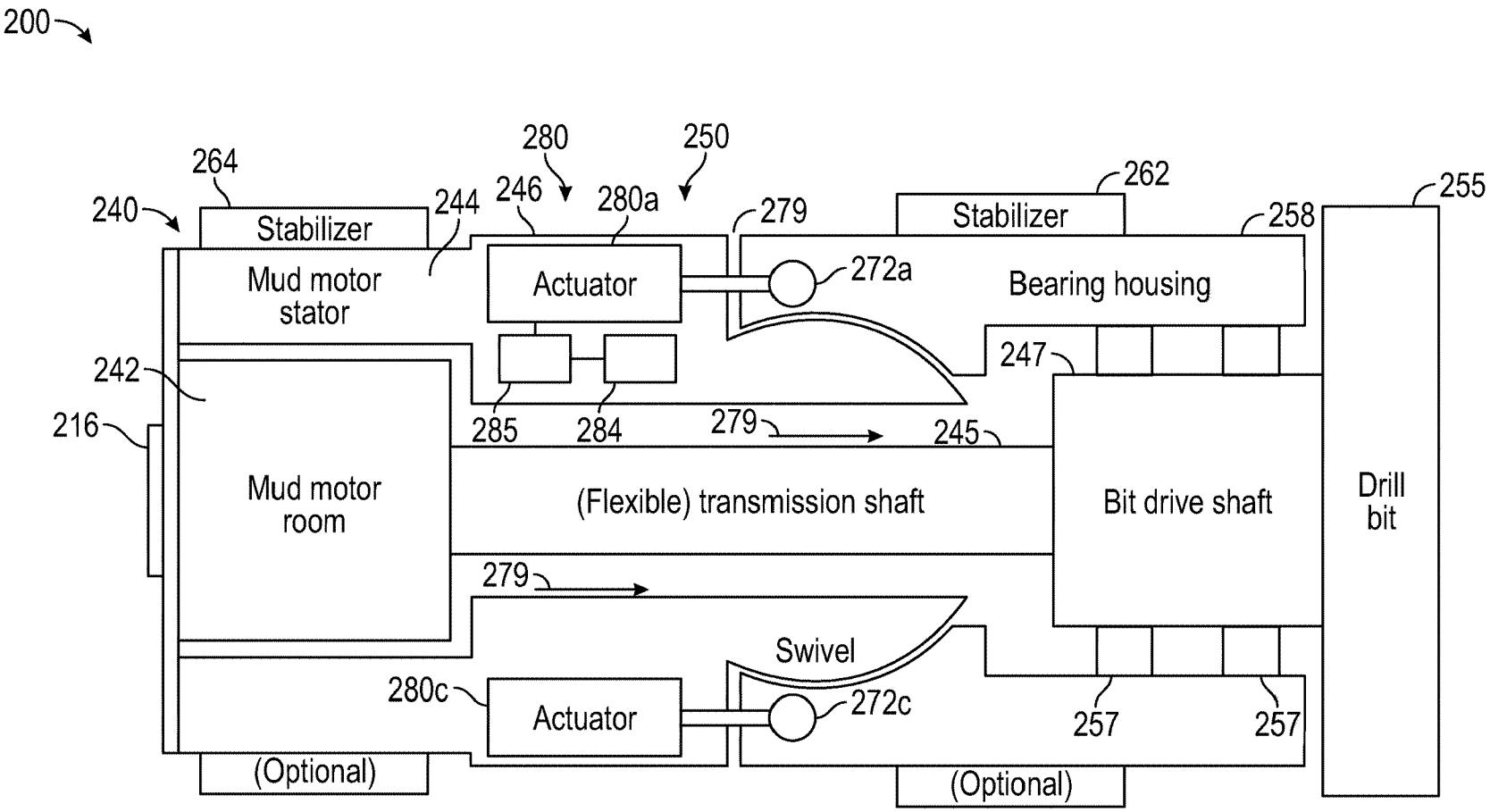
FIG. 2A is a block diagram showing a drilling assembly that includes a steering device combined with a drilling motor, according to one non-limiting embodiment of the disclosure herein.

FIG. 2A is a block diagram of a drilling assembly 200 showing relative position of various devices contained in the drilling assembly. The drilling assembly 200 is connected to a drill pipe 216 at its top or upper end and a disintegrating device, such as drill bit 255, at its bottom or lower end. The drilling assembly 200 includes a drilling motor or mud motor 240 that includes a rotor 242 that rotates inside a stator 244 having an outer housing 246 (also referred to herein as the "upper section"). The rotor 242 is connected to a flexible transmission member or shaft 245, which in turn is connected to a bit drive shaft 247, which in turn is connected to the drill bit 255. During drilling operations, the rotor 242 rotates within the stator 244 due to the flow of the drilling fluid 279 through the drilling motor 240. The rotor 242 rotates the flexible shaft 245 and the bit drive shaft 247, thereby rotating the drill bit 255 at the rotor rpm. The drill bit 255 also rotates when the drilling assembly 200 is rotated. Thus, the drill bit rotational speed is the sum of the rotational speeds of the rotor 242 and the rotational speed of drilling assembly 200. The drilling motor housing 246 (also referred to herein as the "upper section") is coupled to a bearing housing 258 (also referred to herein as "the lower section") that supports the bit drive shaft 247 via bearings 257. Stabilizers 262 and 264 may be provided respectively over the bearing housing 258 and drilling motor housing 246 to provide stability to the drilling motor 240 and the drill bit 255. The drilling motor housing 246 and the bearing housing 258 are coupled to each other by a steering device 250. The steering device 250 includes a tilt device or a tilt mechanism 270 and an actuation device or unit 280 that tilts the tilt device 270 when the drilling assembly is rotating. In one non-limiting embodiment, the actuation device 280 includes three or more actuators 280*a*, 280*b*, 280*c*, etc., around shaft 245 and/or 247. The tilt device 270, in one non-limiting embodiment, includes a joint 274 and an adjuster 272. The adjuster 272 may include a force application member corresponding to each of the actuators 280*a*-280*c*, such as force application members 272*a*-270*c*. Each force application member is connected to the joint 274 that moves about location 275. Gap 279 enables the lower section 258 to move about the joint 274 in any desired direction. The joint 274 may be any suitable joint that may swivel or tilt about a section 275 and configured to cause the lower section 258 to tilt relative to the upper section 246 in any desired direction. In one aspect, the joint 274 may be a cardanic joint (including a knuckle joint or a universal joint). Each actuator 280*a*-280*c* selectively moves its corresponding force application member 272*a*-272*c* while the drilling assembly 200 is rotating to cause the lower section 258 to tilt relative to the upper section 246 a selected angle along any desired direction about the joint 274. A control circuit, unit or controller 285 may control the operation of the actuation device 280 in response to one or more downhole parameters or measurements made by suitable sensors 284 in real time. Sensors 284 may include, but are not limited to, accelerometers, magnetometers and gyroscopes. Sensors 284 and/or controller 285 may be placed at any suitable location in the drilling assembly In one non-limiting embodiment, the actuators 282*a*-282*c* are electro-mechanical devices, as described in more detail in reference to FIGS. 3-4. In the embodiment of FIG. 2A, the joint 274 is below, (i.e. downhole of) the rotor 242. The flexible shaft 245 runs through the joint 274, which shaft provides drilling energy (rpm) to the drill bit 255. The controller 285 dynamically controls the actuators 280*a*-280*c* and thus the motion of the force application members 272*a*-272*c* to cause the lower section 258 and thus the drill bit 255 to tilt a desired or selected amount and along a desired direction while the drilling assembly 200 is rotating in response to one or more downhole measurements determined or measured in real time. The use of the steering device 250 in the drilling assembly 200 as part of a mud motor 240 allows rotation of the drill string 130 (FIG. 1) and thus the steering device 250 at a relatively low rotational speed (rpm) compared to conventional rotary steerable drilling systems. The (low) drill string rpm reduces stick slip and friction of the drilling assembly 200 while allowing the drill bit 255 to rotate at an optimum rpm, driven by the mud motor rpm and the string rpm, thus providing high rate of penetration of the drill bit 255 into the formation. The relatively low rpm requirement of the drilling assembly 200 and thus that of the steering device 250 requires less mechanical power from the actuation device 280. Low drill string rpm also induces less dynamic mechanical stress on the entire drill string 120, including its various components that includes the drilling assembly 200 and its variety of sensors and electronic components. Further advantages over conventional motor drilling include allowing the drilling assembly 200 to rotate through curvatures of the wellbore and being able to adjust the drilling assembly 200 to a substantially straight mode for drilling straight sections of the wellbore.

Figure 2B:
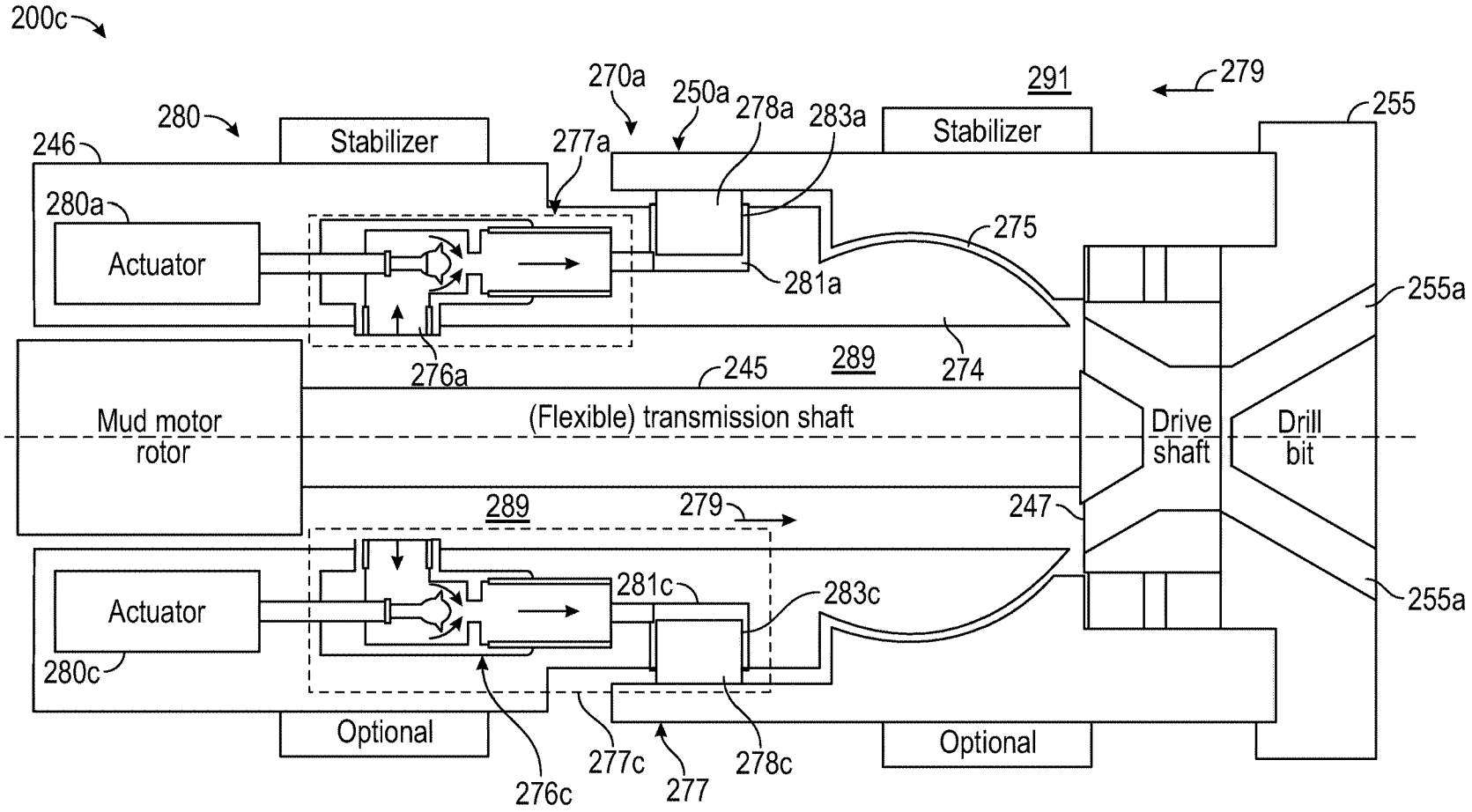
FIG. 2B is a block diagram of a drilling assembly that utilizes another embodiment of a steering device made according to another non-limiting embodiment of the disclosure herein.

FIG. 2B is a block diagram of a drilling assembly 200*a* that utilizes a steering device 250*a* that includes an actuation device 280 and a tilt device 270*a*. The actuation device 280 shown is the same as shown in FIG. 2 and includes three or more actuators 280*a*-280*c* disposed around drive 245/247. The tilt device 270*a* includes an adjuster 277 and a joint 274. In one non-limiting embodiment, the adjuster 277 includes a separate hydraulic force application device corresponding to each of the actuators 280*a*-280*c*. In FIG. 2, force applications devices 277*a*-277*c* respectively correspond to and connected to actuators 280*a*-280*c*. The actuators 280*a*-280*c* selectively operate their corresponding force application devices 277*a*-277*c* to tilt the lower section 258 relative to the upper section 246 about the joint 274 when the drilling assembly 200*a* is rotating. In one non-limiting embodiment, each of the force application devices 277*a*-277*c* includes a valve in fluid communication with pressurized fluid 279 flowing through channel 289 in the drilling assembly 200*a* and a chamber that houses a piston. In the embodiment of FIG. 2B, force application devices 277*a*-277*c* respectively include valves 276*a*-276*c* and pistons 278*a*-278*c* disposed respectively in chambers 281*a*-281*c*. During drilling, pressurized drilling fluid 279 flowing through channel 289 around the shafts 245 and 247 exits through the passages or nozzles 255*a* in the drill bit 255 connected to the drilling assembly 200*a*. The exiting fluid 279*a* returns to the surface via annulus 291, which creates a pressure drop between the channel 289 and the annulus 291. In aspects, the disclosure herein utilizes such pressure drop to activate the hydraulic force application devices 277*a*-277*c* to create a desired tilt of the lower section 246 relative to the upper section 246 about the joint 274 and to maintain such tilt geostationary while the drilling assembly 200*a* is rotating. To tilt the drill bit 255 via the sections 258 and 246, the actuators 280*a*-280*c* selectively open and close their corresponding valves 276*a*-276*c*, allowing the pressurized fluid 279 from channel 289 to flow to the cylinders 281*a*-281*c* to extend pistons 278*a*-278*c* radially outward. Each piston and cylinder combination may include a gap, such as gap 283*a* between piston 278*a* and cylinder 281*a* and gap 283*c* between piston 278*c* and chamber 281*c*. Such a gap allows the fluid entering a chamber to escape from that chamber into the annulus 291 when the valve is open and the piston is forced back into its cylinder. Alternatively, one or more nozzles or bleed holes (not shown) connected between the cylinder and the annulus 291 may be provided to allow the fluid to flow from the chamber into the annulus 291. To actively control the tilt of the lower section 258 while the rotary steerable drilling assembly 200*a* is rotating, the three or more valves 276*a*-276*c* may be activated sequentially and preferably with the same frequency as the rotary speed (frequency) of the drilling assembly 200*a*, to create a geostationary tilt between the upper section 246 and the lower section 258. For instance, referring to FIG. 2B, if an upward drilling direction is desired, the actuator 280*c* is momentarily opened, forcing the piston 278*c* to extend outward. At the same moment, actuator 280*a* would close valve 276*a*, blocking pressure from the channel 289 to the piston 278*a*. Since all pistons 276*a*-276*c* are mechanically coupled through the joint 274, piston 278*a* would return or retract upon the outboard stroke of piston 278*c*. When the assembly 200*a* rotates, e. g. by 180° and for the case of four actuators distributed around the circumference of the assembly 200*a*, the activation would reverse, actuator 280*a* opening valve 276*a* and actuator 280*c* closing valve 276*c*, thus maintaining a geostationary tilt direction. Similar methods may be utilized to tilt and maintain such tilt geostationary for the embodiment shown in FIG. 2A.

Figure 3A:
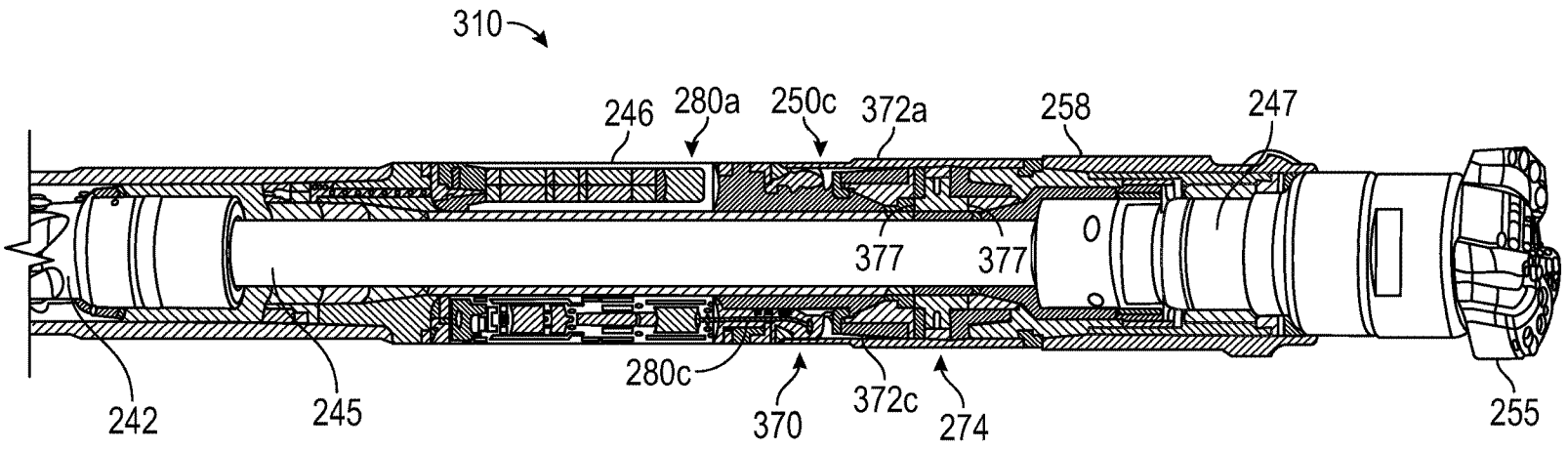
FIG. 3A shows a cross-section of a drilling assembly that shows certain components of a steering device made according to one non-limiting embodiment of the disclosure herein.

FIG. 3A is a cross-section of a portion 310 of a drilling assembly that includes a lower section 258 that is configured to tilt relative an upper section 246 by a steering device 250, which may be device 250*a* or 250*b* respectively shown in FIGS. 2A and 2B. In the drilling assembly section 310, the rotor 242 of the drilling motor is connected to the transmission shaft 245, which is connected to the drill bit drive shaft 247 that rotates the drill bit 255. The steering device 350 includes an actuation device 322 that includes three or more actuators 322*a*-322*c* (only 322*a* is visible) disposed around or outside drive 245/247 as described in reference to FIGS. 2A and 2B. A tilt device 375 includes an adjuster 370 that is configured to tilt the lower section 258 with respect to the upper section 246 about a joint 374. The adjuster 370 includes three or more force application devices, such as devices 324*a*-324*c* respectively connected to actuators 322*a*-322*c*. The devices 324*a*-324*c* may be either devices 272*a*-272*c* (FIG. 2A) or devices 277*a*-277*c* (FIG. 2B) or other suitable devices. During drilling, the rotation of the drilling assembly section 310 and that of the rotor 242 rotate the drill bit 255 while the actuators 322*a*-322*c* selectively activate their corresponding force application devices 324*a*-324*c*. The force and axial displacement or motion output of each actuator is received by the adjuster 370, transferring such substantially axial force and displacement into substantially radial output that is further used to tilt the lower section 258 relative to the upper section 246 and maintain the tilt geostationary or substantially geostationary to form a deviated section of the wellbore. The joint 274 transfers axial and torsional loads between the upper section 246 and the lower section 258 while maintaining angular flexibility between these two sections.

Figure 3B:
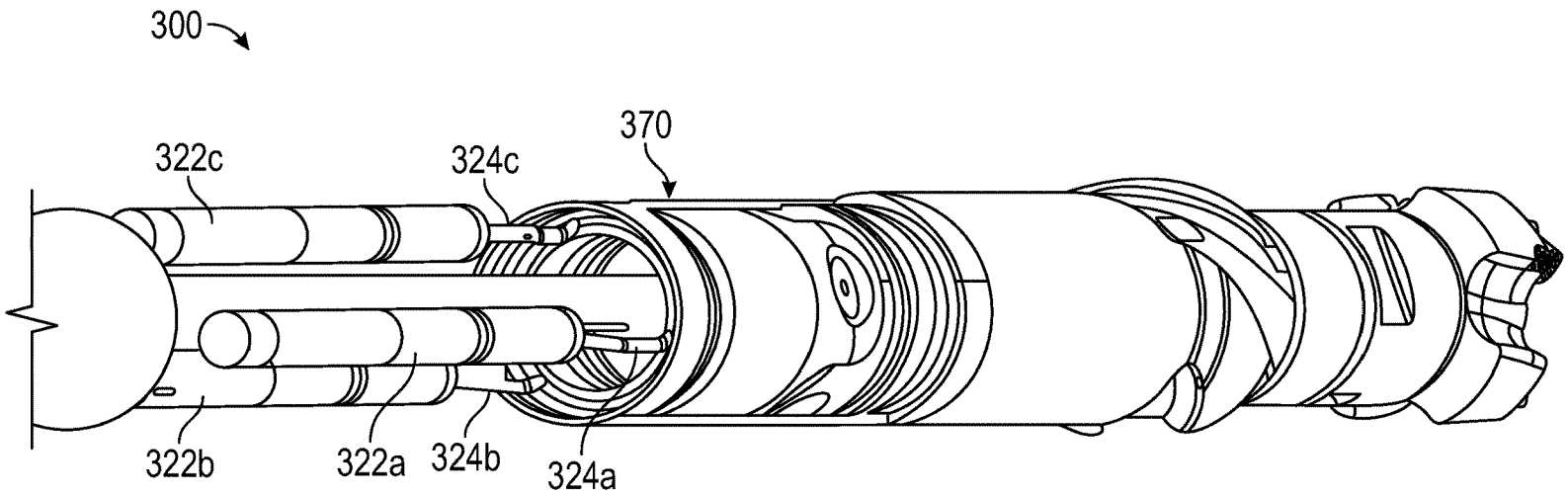
FIG. 3B shows an isometric glass view of an actuation device or actuator unit that includes a number of electro-mechanical actuators that selectively apply force on a tilt device to steer the drill bit along a desired direction.

FIG. 3B shows an isometric glass view of an actuation device 300 connected to an adjuster 370 that may be utilized in a drilling assembly. The actuation device 300 includes a number of individual actuators, such as actuators 322*a*, 322*b* and 322*c* placed spaced apart around a drive 245. Each such actuator includes a movable member that acts on a respective force application member 324*a*-324*c* to move the adjuster 370 along any desired direction. When the drilling assembly is rotated, the actuators 322*a*, 322*b* and 322*c* and their corresponding force application devices 324*a*-324*c* rotate with the entire assembly. The actuators 322*a*-322*c* extends and retracts their respective members 324*a*-324*c* to apply desired amounts of forces and displacements on adjuster 370 to tilt a lower section relative to an upper section of a drilling assembly.

Figure 4:
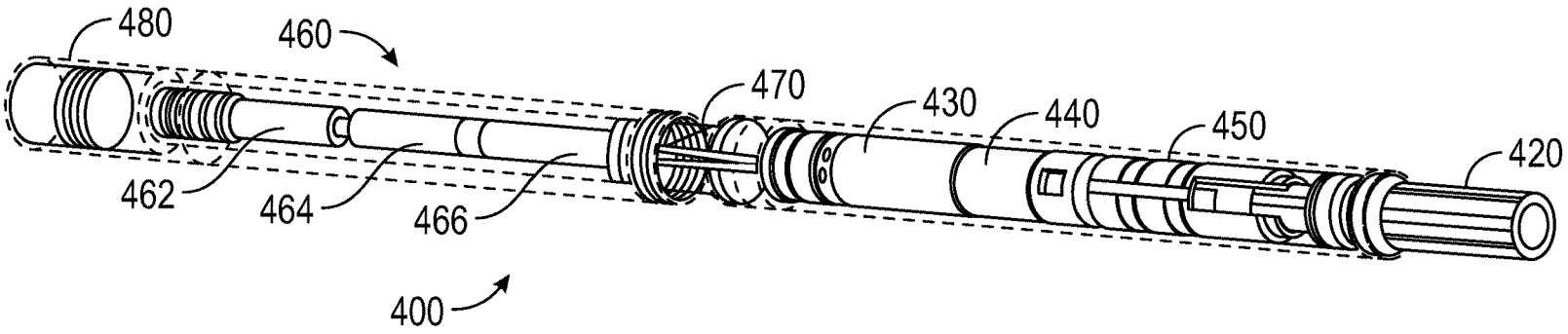
FIG. 4 shows a modular electro-mechanical actuator that may be used as an individual actuator in the actuation device shown in FIGS. 2A-FIG. 3.

FIG. 4 shows certain elements or components of an individual actuator 400 for use as actuators 322*a*-322*c* in the steering device 300 of FIG. 3. In one aspect, the actuator 400 is a unitary device that includes a movable end 420 that can be extended and retracted. The actuator 400 further includes an electric motor 430 that may be rotated in clockwise and anticlockwise directions. The motor 430 drives a gear box 440 (clockwise or anti-clockwise) that in turn rotates a drive screw 450 and thus the end 420 axially in either direction. The actuator 400 further includes a control circuit 460 that controls the operation of the motor 430. The controller 460 includes electrical circuits 462 and may include a microprocessor 464 and memory device 466 that houses instructions or programs for controlling the operation of the motor 430. The control circuit 460 is coupled to the motor 430 via conductors through a bus connector 470. In aspects, the actuator 400 may also include a compression piston device or another suitable device 480 for providing pressure compensation to the actuator 400. Each such actuator may be a unitary device that is inserted into a protective housing disposed in the actuator unit 150 (FIG. 1). During drilling, each such actuator is controlled by its control circuit, which circuit may communicate with the controller 270 (FIG. 1) and/or controller 190 (FIG. 1) to exert force on the adjuster 370 (FIG. 3).

Referring to FIGS. 1-4, A steering unit made according to an embodiment described herein forms part of the lower portion of a drilling assembly, such as drilling assembly 130 (FIG. 1) of a drilling system 100. The steering unit includes a tilt device that further includes an adjuster coupled to a joint, wherein an actuation device or actuator unit maneuvers or tilts the joint about a drilling assembly axis. A transmission shaft connected to a rotor of a drilling motor passes through the adjuster and the joint and rotates the drill bit as the drilling motor rotor rotates. The adjuster is actively moved by a selected number of intermittently activated modular electro-mechanical actuators of the actuation device. The actuators rotate with the drilling assembly and are controlled by signal inputs from one or more position sensors in the drilling assembly that may include magnetometers, accelerometer and gyroscopes. Such sensors provide real time position information relating to the wellbore orientation while drilling. Depending on the type and the design of the adjuster, the actuators may perform reciprocating or rotary oscillating movement, e. g., coupled to a cam or crank system further enabling the eccentric offset in any desired direction from the drilling assembly axis during each revolution of the drilling assembly, creating a geostationary force and offset of the swivel axis. Additionally, the drilling system 100 disclosed herein does not require a control unit to counter-rotate the tool body rotation. The modular actuators positioned in the outer diameter of the actuation assembly receive command signals from a controller located in another section of the tool or higher up in the drilling assembly that may also include navigational sensors. These navigational sensors rotate with the drilling assembly. Such a mechanism can resolve and process the rotary motion of the drilling assembly to calculate momentary angular position (while rotating) and generate commands to the individual actuators substantially instantaneously.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A rotary steerable drilling assembly configured to drill a deviated section of a wellbore, the rotary steerable drilling assembly comprising:

a drilling motor coupled to a drive member, the drilling motor rotating due to a flow of a drilling fluid;

a housing outside the drive member having a first section and a second section;

a steering device that tilts the first section relative to the second section about a joint and maintains the tilt substantially geostationary when the drilling assembly is rotating through curvatures of the wellbore; wherein the drive member runs through the joint to couple the drilling motor to a disintegrating device having fluid passages, and wherein the drilling motor rotates the disintegrating device via the drive member; and a channel between the joint and the drive member, wherein the drilling fluid flows through the channel between the joint and the drive member and exits through the fluid passages in the disintegrating device.

2. The drilling assembly of claim 1, wherein the steering device includes: an actuation device; and a tilt device coupled to the first section and second section; and wherein the actuation device applies selected forces onto the tilt device to cause the first section to tilt relative to the second section.

3. The drilling assembly of claim 2, wherein the tilt device includes an adjuster coupled to the joint and wherein the actuation device applies the selected forces onto the adjuster to cause the first section to tilt relative to the second section about the joint.

4. The drilling assembly of claim 2, wherein the tilt device includes an adjuster coupled to the joint and wherein the actuation device includes one or more spaced apart actuators, and wherein each such actuator applies a first selected force on the adjuster to tilt the first section relative to the second section.

5. The drilling assembly of claim 4, wherein each actuator rotates when the drilling assembly rotates and applies force on the adjuster during each rotation of the drilling assembly.

6. The drilling assembly of claim 5, wherein the adjuster includes a force application device corresponding to each actuator, and wherein each actuator causes its corresponding force application device to apply force on the first section to cause the first section to tilt relative to the second section about the joint.

7. The drilling assembly of claim 4, wherein each actuator oscillates during each rotation of the drilling assembly to create a substantially geostationary force and an offset to an axis of the steering device.

8. The drilling assembly of claim 4, wherein each actuator is a modular unit that includes a motor coupled to a force application device and wherein the motor performs an oscillatory movement to cause the force application device to apply a second selected force on the first section.

9. The drilling assembly of claim 8, wherein the adjuster transfers the oscillatory movement for each actuator into an eccentric offset.

10. The drilling assembly of claim 4 further including a controller that controls an oscillatory movement of each actuator.

11. The drilling assembly of claim 2, wherein the actuation device includes a plurality of spaced apart actuators, and wherein each such actuator is configured to apply force on an abutting element of the tilt device.

12. The drilling assembly of claim 11, wherein the abutting element is selected from a group consisting of: a cam; a crank shaft; an eccentric member; a valve; a ramp element; and a lever.

13. The drilling assembly of claim 11 further including a controller that controls a movement of at least one of the actuators in the plurality of actuators.

14. The drilling assembly of claim 11, wherein the force on the abutting elements of the tilt device create a geostationary or substantially geostationary tilt of the tilt device.

15. The drilling assembly of claim 1, wherein the steering device includes an actuator coupled to a force application device that includes a valve and a piston, wherein the actuator controls the valve to supply pressurized fluid flowing through the drilling assembly to cause the piston to apply force on the first section to cause the first section to tilt relative to the second section about the joint.

16. The drilling assembly of claim 1 further comprising a controller that controls the tilt of the first section in response to a parameter of interest.

17. A method of drilling a deviated section of a wellbore, comprising:

conveying a rotary steerable drilling assembly into the wellbore that includes:

a drilling motor coupled to a drive member configured to rotate a disintegrating device, the drilling motor rotating due to a flow of a drilling fluid and the disintegrating device having fluid passages, and wherein the drilling motor rotates the disintegrating device via the drive member, a housing outside the drive member, a steering device that tilts a first section of the housing relative to a second section of the housing about a joint, wherein the drive member runs through the joint to couple the drilling motor to the disintegrating device, and a channel between the joint and the drive member, wherein the drilling fluid flows through the channel between the joint and the drive member and exits through the fluid passages in the disintegrating device;

rotating the drilling assembly and the drilling motor to rotate the disintegrating device to drill the wellbore; and activating the steering device while the drilling assembly is rotating to tilt the first section relative to the second section about the joint to drill the deviated section.

18. The method of claim 17, wherein the steering device includes an actuation device and a tilt device, wherein the method further comprises activating the actuation device to apply selected forces onto the tilt device to cause the first section to tilt relative to the second section about the joint when the drilling assembly is rotating.

19. The method of claim 18, wherein the tilt device includes an adjuster coupled to the joint and wherein the actuation device applies the selected forces onto the adjuster to cause the first section to tilt relative to the second section about the joint.

20. The method of claim 19, wherein the actuation device includes one or more actuators and a force application device corresponding to each such actuator, wherein the method further comprises: activating each actuator once each rotation of the drilling assembly to apply force on its corresponding force application device to tilt the first section relative to the second section and to maintain such tilt substantially geostationary.

21. The method of claim 20 further comprising providing each force application device with a valve and a piston and operating each such valve to supply a pressurized fluid flowing through the drilling assembly to cause each piston to apply selected forces on the first section to cause the first section to tilt relative to the second section about the joint.

22. The method of claim 20, wherein each actuator oscillates during each rotation of the drilling assembly to create a substantially geostationary force and an offset to an axis of the steering device.

23. The method of claim 20, wherein each actuator is a modular unit that includes a motor coupled to the force application device and wherein each motor performs an oscillatory movement to cause the force application device to apply selected forces on the first section.

24. The method of claim 17 further comprising using a controller to control the tilt of the first section in response to a downhole parameter of interest.

* * * * *